United States Patent [19]

Avedikian

[11] 3,934,986

[45] Jan. 27, 1976

[54] INSTANT STARTING BRIQUETTES

[76] Inventor: Souren Z. Avedikian, 161 Harbor Drive, Key Biscayne, Miami, Fla. 33149

[22] Filed: Jan. 25, 1974

[21] Appl. No.: 436,501

[52] U.S. Cl. ..... 44/6; 44/41

[51] Int. Cl.[2] ..... C10L 9/00; C10L 10/00

[58] Field of Search ..... 44/6, 15 R, 41

[56] References Cited

UNITED STATES PATENTS 2,604,389 7/1952 Berdick et al. ..... 44/6 X 3,431,093 3/1969 Kreinik ..... 44/6

*Primary Examiner*—Carl F. Dees

*Attorney, Agent, or Firm*—Marn & Jangarathis

[57] ABSTRACT

There is disclosed an instant starting briquette, readily lighted by the application of a match or similar source of heat energy, wherein the briquette is formed by impregnating a carbonaceous material with a combustion supporting material and a compound selected from the group, consisting of trioxane and tetraoxane.

2 Claims, No Drawings

INSTANT STARTING BRIQUETTES

This invention relates to instant-igniting charcoal, and more particularly to charcoal which is made instant igniting by impregnating the charcoal with a mixture of a symmetrical cyclic ether selected from the group consisting of trioxane and tetraoxane and a combustion supporting material selected from the group of straight chain aliphatic alcohols and hydrocarbons or mixtures thereof.

BACKGROUND OF THE INVENTION

Substantial problems are encountered in the handling and igniting of solid fuels in small pieces or lump forms, such as, for example, charcoal briquettes with are compressed from a solid carbonaceous fuel in powdered or finely divided form. Charcoal, one of the solid carbonaceous fuels, is widely used in lump or briquette form as a fuel for grills, barbecues and like cooking equipment for broiling, barbecueing and grilling. However, charcoal and other carbonaceous fuels in lump or briquette form has the serious disadvantage when used as a fuel of being extremely difficult to initially ignite in order to obtain combustion thereof sufficient for the fuel to burn to the desired more or less flameless bit of coals or embers required for grilling, barbecueing or other broiling purposes.

For example, with charcoal in lump or briquette form, it is necessary to employ some form of kindling or liquid igniting fuel, such as benzine, kerosene, methylalcohol, and the like, in sufficient quantity to burn for the necessary time to ignite the charcoal which has been raised to the point of self burning. With the use of kindling or starting fuels, it is difficult to time the igniting of the charcoal and the combustion thereof to the point where the desired fire is established for properly and satisfactorily grilling and broiling thereover. The use of the liquid fuels has resulted in injury due to flashing and flaming up of the highly volatile substances therein, and generally results in a smoky flame. Additionally, nitrates, nitrides and nitrocelluloses and other easily ignited materials have been combined with the hereinabove mentioned liquid fuels to assist in the ignition thereof have caused undesirable pirotechnic effects. All of the prior art materials tend to pollute the air.

Charcoal and similar carbonaceous fuels in lump or briquette form present a further serious disadvantage from the standpoint of transportation, storage and distribution thereof, as well as in the handling thereby of the ultimate user as a result of the relatively porous and soft characteristics of such fuels. Such characteristics are of particularly disadvantage in bulk handling, transportation and distribution thereof, for dust and soot accumulates therefrom in the containers or carriers resulting, in some instances, in the spontaneous combustion and ignition of the mass of fuel. The soot or dust problems have been of particular problem to the retailer or seller or such fuels to the ultimate consumer. Such retailer merchants have had a reluctance, even when the fuel is bagged and packaged in conventional packaging form to sufficiently stock such packaged fuels because of the space requirements and the difficulty of stacking or placing them in a position readily available to the customer, particularly as a result of the inevitable soiling or sooting of the packages as a result of handling. Consequently, retailers keep only a small supply of such package fuels.

Many solutions to the problems of self-igniting carbonaceous matter have been advanced, for example, U.S. Pat. No. 2,381,891, there is disclosed a process for incorporating combination of the various combustible material with particulate carbonaceous material which is subsequently briquetted to form a fuel composition to be used as a fire kindler. In U.S. Pat. No. 2,816,013, there is disclosed a process for impregnating a fuel body (charcoal briquette) with a pure liquid alkane and subsequently immersing the impregnated briquette into a second liquid material which polimerizes and forms a coating about the briquette. In addition to such suggestions, other solutions have been advanced, including the impregnating of the briquettes with a volatile material with the subsequent packaging of such impregnated material in an impervious container. Still further aids in igniting charcoal beds are directed to kindling tablets, e.g., U.S. Pat. No. 2,854,321.

OBJECTS OF THE INVENTION

An object of the present invention is to provide an improved impregnated carbonaceous fuel which obviates the problems of the prior art.

Still another object of the present invention is to provide an improved impregnated briquette which may be stored for long periods of time without substantial loss of desired properties.

SUMMARY OF INVENTION

These and other objects of this invention are achieved by instant briquette which is readily lighted by the application of a match or similar source of heat energy.

It has been unexpectedly found that the incorporation of a compound selected from the group consisting of trioxane and tetraoxane with a combustion supporting material which is a solid at ambient temperatures, such as disclosed in the prior art, as the impregnating liquid for charcoal briquettes has resulted in an improved instant charcoal briquette which may be stored for indefinite periods of time without losing its kindling capabilities, as well as substantially eliminating the problems inherent with the handling of charcoal briquettes, per se. The instant charcoal briquettes are safe to use and clean to handle. Further, with preferred combustible supporting materials, as hereinafter described, the product of the present invention is safe to handle and the combustion thereof does not yield toxic gases.

The combustible materials contemplated by the present invention should provide sufficient caloric heat value to ignite the carbonaceous material. The impregnation mixture should be solid at ambient temperatures. The combustible supporting fuel material must have a melting point above ambient temperatures, and have a vapor pressure such that at room temperatures, the impregnation material does not appreciably evaporate over extended periods of time.

It will be appreciated from the prior art that there is an overcopious number of combustible materials which can be utilized to sustain combustion for a period of time sufficient to ignite the substrate charcoal. In a preferred form of the invention, where it is desirable to have an extremely clean burning impregnated briquette, the use of the straight chain aliphatic alcohols and acids are desired. The straight chain alcohols include cetyl alcohol, stearyl alcohol and the like. The straight chain aliphatic acids include those such as palmitic stearyic and the like.

Generally, it is desired to increase the weight of the charcoal substrate by about 10% to 20% by weight of the impregnating mixture. The impregnating mixture is comprised of a ratio of trioxane and/or tetraoxane to combustion supporting material in a ratio of from about 1 to 4 to 1 to 2. For certain applications, a mixture of combustible materials may be used, e.g., of from 50% to 90% cetyl alcohol with the remaining balance formed of another straight chained alcohol has produced an excellent, non-polluting instant charcoal, when used with trioxane to impregnate and coat a charcoal briquette or substrate. It has also been found that trioxane may be combined with tetraoxane prior to adding to the combustible material. In all instances, it has been found that the instant charcoal of the present invention is inert and safe to store and handle until such time as a flame source is applied thereto.

Impregnation of the charcoal substrate, whether in the form of a briquette or other shapes, may be accomplished by immersing the charcoal substrate, while at room temperature, into a molten bath or solution of the hereinabove mentioned impregnation liquid, i.e., a mixture of trioxane and/or tetraoxane, together with the combustible supporting material, heated to and maintained at an elevated temperature to keep the impregnation material in a liquid state (not withstanding the possible cooling effect of the charcoal substrate being immersed into the liquid material). The charcoal substrate is maintained with the bath for from with one to thirty minutes to permit the molten solution to penetrate into the interstices of the charcoal substrate.

In a preferred embodiment of the present invention, it is desired to immerse the charcoal while at an elevated temperature, i.e., briquettes as they are withdrawn from the production line and before they are cooled, i.e., approximately 94° C., into the liquid bath of impregnation material whereby the cooling of the charcoal will effect rapid penetration of the liquid into the interstices of the charcoal substrate. After cooling, the impregnated charcoal substrate is packaged for introduction into commerce.

The following examples are illustrative of the instant charcoal of the present invention, and it is to be understood that the scope of the invention is not to be limited thereby.

EXAMPLE 1

An instant charcoal is formed having the following composition:

| | Wt. % |
|---|---|
| Charcoal Substrate | 80 |
| Alcohol (straight chain aliphatic) | 13.4 |
| Trioxane (or Tetraoxane) | 6.6 |
| | 100 % |

EXAMPLE 2

The impregnation solution for Example 1 had the following composition:

| | Wt. % |
|---|---|
| Alcohol (straight chain aliphatic) | 67 |
| Trioxane | 33 |
| | 100 % |

in which the ratio of the straight chain aliphatic alcohols of cetyl, stearyl, myristyl, arachidyl, is in a ratio of from 50.25; 12.05; 3.02; 1.68.

EXAMPLE 3

An instant charcoal is formulated having the following composition:

| | Wt. % |
|---|---|
| Charcoal Substrate | 70 |
| Alcohols (straight chain aliphatic) | 20.1 |
| Trioxane | 9.9 |
| | 100.00 % |

EXAMPLE 4

Another instant charcoal of the present invention is comprised of the following composition:

| | Wt. % |
|---|---|
| Charcoal Substrate | 80 |
| Alcohols (straight chain aliphatic) | 13.4 |
| Trioxane | 4.4 |
| Tetraoxane | 2.2 |
| | 100 % |

The ignition of the instant charcoal of the present invention may be effected by a lighted match which produces a gentle flame resistant to the effects of wind condition and which lasts from about 5 to 15 minutes depending upon the length of time of impregnation which effects the amount of impregnating mixture added to the charcoal substrate. After completion of the flaming time period, the charcoal substrate has reached ignition temperature and a bed of glowing embers is generally available within about 25 minutes after ignition of the instant charcoal of the present invention.

While we have described the invention as being applicable to the impregnation of charcoal briquettes or substrates, it is understood that other substrates may be used, e.g., coal, coke, woodchips, recycled waste or various other woods or like substances. It is also understood that the substrate may be formed in various shapes which would not affect the operation of the present invention.

It is contemplated that in one embodiment of the invention, the charcoal substrate would be formed with one or more holes passing therethrough into which there is positioned a cord, string, wick or other fusing means, also impregnated with the impregnation mixture as disclosed above. Upon ignition of the cord or the like, the cord acts as a fuse to ignite the charcoal briquette. A plurality of such instant charcoal briquettes having a hole therethrough may be strung on a cord of sufficient number to form a normal barbecue bed.

While the invention has been described in connection with several exemplary embodiments thereof, it will be understood that many modifications will be apparent to those of ordinary skill in the art; and that this application is intended to cover any adaptation or variation thereof what is claimed.

What is claimed:

1. An improved instant-igniting charcoal briquette impregnated with a combustion supporting material selected from the group consisting of straight chain aliphatic alcohols, acids, and mixtures thereof which have a minimal vapor pressure at room temperatures and have a melting point above ambient temperatures and a compound selected from the group consisting of trioxane, tetra-oxane and mixtures thereof.

2. The instant charcoal as defined in claim 1 wherein the substance is formed with a ratio of said compound to said combustible material of from 1 to 4 to 1 to 2.

* * * * *